US005445665A

United States Patent [19]

Matthews et al.

[11] Patent Number: 5,445,665

[45] Date of Patent: Aug. 29, 1995

[54] MACHINABLE BRASS COMPOSITIONS

[75] Inventors: Paul E. Matthews, Lawrenceville, N.J.; Thomas W. Pelletiers, II, Bethlehem, Pa.

[73] Assignee: United States Bronze Powders, Incorporated, Flemington, N.J.

[21] Appl. No.: 94,017

[22] PCT Filed: Jan. 28, 1992

[86] PCT No.: PCT/GB92/00154

§ 371 Date: Sep. 29, 1993

§ 102(e) Date: Sep. 29, 1993

[87] PCT Pub. No.: WO92/13110

PCT Pub. Date: Aug. 6, 1992

[30] Foreign Application Priority Data

Jan. 29, 1991 [GB] United Kingdom ..... 9101828

[51] Int. Cl.[6] ..... C22C 9/04

[52] U.S. Cl. ..... 75/255; 75/243; 75/252; 420/477; 420/476

[58] Field of Search ..... 75/229, 230, 231, 243, 75/252, 255; 252/29, 30; 420/476, 477

[56] References Cited

U.S. PATENT DOCUMENTS

| | | | |
|---|---|---|---|
| 2,887,765 | 5/1959 | Thomson et al. | 75/243 |
| 3,361,666 | 1/1968 | Webb et al. | 252/30 |
| 3,453,103 | 1/1969 | Tracey et al. . | |
| 3,717,445 | 2/1973 | Yoshimura et al. | 75/229 |
| 4,000,981 | 1/1977 | Sugafuji et al. | 75/230 |
| 4,747,873 | 5/1988 | Kamioka | 75/229 |

FOREIGN PATENT DOCUMENTS

| | | | |
|---|---|---|---|
| 1082624 | 12/1954 | France . | |
| 615172 | 1/1949 | United Kingdom . | |
| 100651 | 8/1965 | United Kingdom . | |
| 589270 | 1/1978 | U.S.S.R. | C22C 9/12 |

*Primary Examiner*—Scott Kastler

*Attorney, Agent, or Firm*—Woodcock, Washburn, Kurtz, Mackiewicz & Norris

[57] ABSTRACT

A powdered metallurgical composition comprising copper and zinc, which composition also includes a proportion of 0.1 to 1.5% by weight of graphite to improve the machinability of an article made from the composition.

19 Claims, No Drawings

MACHINABLE BRASS COMPOSITIONS

DESCRIPTION

This invention relates to machinable brass compositions including compositions containing elemental and/or pre-alloyed non-ferrous metal powders, organic lubricants, and with or without flake graphite additives. Pre-alloyed brass compositions are commonly used in the manufacture of components such as lock hardware—latch bolts, padlock bodies, tumblers and miscellaneous hardware, i.e. nuts, knobs, control handles and cams. In commercial powder metallurgy practices, powdered metals are convened into a metal article having virtually any desired shape.

BACKGROUND OF THE INVENTION

The powdered metal is firstly compressed in a die to form a "green" preform or compact having the general shape of the die. The compact is then sintered at an elevated temperature to fuse the individual metal particles together to form a unitary sintered metal part having a useful strength and yet still retaining the general shape of the die in which the compact was made.

Thereafter the shaped component is then machined to its final form for example by drilling, tapping and turning.

Metal powders utilized in such processes are generally pure metals, or alloys or blends of these, and sintering will yield a part or component having between 60% and 95% of its theoretical density. If a particularly high density is required, then a process such as a hot isostatic pressing will be utilized instead of sintering.

Brass alloys used in such processes are comprised of approximately 10% to 30% of zinc and 70% to 90% of copper.

Solid lubricants can also be included in the components and these are typically waxes, metallic/non-metallic stearates, graphite, lead alloy, molybdenum disulfide and tungsten disulfide.

For many metallurgical purposes, however, the resulting sintered product has to be capable of being machined, that is to say, it must be capable of being machined without either tearing the surface being machined to leave a rough surface or without unduly blunting or binding with the tools concerned.

It has, hitherto, been common practice for a proportion of lead in an amount up to 10% to be included by way of alloying within the material and to aid and improve the machinability of the resulting product. Lead is, however, a toxic substance and the use of lead in the production of alloys is surrounded by legislation and expensive control procedures. Furthermore, the lead phase in copper lead alloys can be affected by corrosive attacks with hot organic or mineral oil. For example when temperature of such an alloy rises, it has been known that the oil can break down to form peroxides and organic gases which effect a degree of leaching on the lead phase within the alloy. If this leaching progresses to any appreciable extent, the component, if it is a bearing or structural component, may eventually malfunction or fail.

There is, therefore, considerable advantage in reducing, or if possible, eliminating the contents of lead within powder metallurgy compositions. Various proposals have been put forward for doing this. The considerable proportions of lead incorporated in powder metallurgy materials in the past has resulted in ease of machinability and durability of the resulting product component. Replacement of part of the lead by bismuth has been proposed in our co-pending International Application published under No. WO91/14012. This results in successful replacement of part of the lead without a significant reduction in the machineability. It is, however, accompanied by some reduction of transverse strength of the material. For many purposes this reduction in transverse strength is not a significant problem.

SUMMARY OF THE INVENTION

The present applicants have found, however that by adding a proportion of up to 1.5% by weight of graphite, the machinability of the material may be improved while the proportion of lead may be reduced to 2% or less.

According to one aspect of the present invention, therefore, there is provided a powder composition comprising copper and zinc for use in the preparation of brass products by powder metallurgy techniques; characterised in that a proportion of 0.1 to 1.5% by weight of graphite has been added to improve machinability thereof. Preferably the said powder composition comprises 0.1 to 0.5% by weight of graphite.

In a particular aspect of the present invention the composition may contain up to about 2% by weight of lead. Preferably, however, the composition is substantially lead-free. The composition may contain up to 2% by weight of bismuth and the bismuth may be present as elemental bismuth or as a prealloy of bismuth tin or bismuth copper. Such prealloy may be present in an amount of 0.1–2.4% by weight based on the weight of copper-zinc.

Investigations have established that bismuth has no known toxicity. Bismuth is non-toxic and it has developing and proliferating uses in pharmaceuticals, cancer-reducing therapy, as an X-ray opaque material, in surgical implants and other medical equipment which indicate that bismuth, while not only more efficient in improving the machinability, also has low or substantially zero toxicity.

The present invention also includes products when manufactured by powder metallurgy techniques using the powder in accordance with the present invention.

DESCRIPTION OF THE PREFERRED EMBODIMENTS

Following is a description by way of example only of methods of carrying the invention into effect.

EXAMPLE 1: 80/20 NON-LEADED BRASS

A pre-alloyed powder metallurgic brass system comprising 80% copper and 20% zinc was subjected to a number of additions. The material was formed under standard processing conditions into standard MPIF transverse bars which were ¼ inch in height. The said bars were then sintered under standard conditions and tested for transverse rupture strength and drilling speed.

EXAMPLE 2: 90/10 NON-LEADED BRASS

This example was the same as example 1 but used a brass comprising 90% copper and 10% zinc. All testing and processing was identical.

EXAMPLE 3: 70/30 NON-LEADED BRASS

This example was the same as example 1 but used a brass comprising 70% copper and 30% zinc. All testing and processing was identical.

Test Procedure:

Owing to their varying uses, properties, etc. each of brass materials was tested at a different green density; thus:

| Example | Brass Composition | Green Density |
|---|---|---|
| 1 | 80% Cu 20% Zn | 7.6 g/cm$^3$ |
| 2 | 90% Cu 10% Zn | 7.8 g/cm$^3$ |
| 3 | 70% Cu 30% Zn | 7.3 g/cm$^3$ |

All of the bars were sintered at 1600° F. under a $dNH_3$ protective atmosphere for a total time of 45 minutes. This translates to 30 minutes at temperature. Each bar was broken on a Tinius-Olsen testing machine at a crosshead speed of approximately +0.250.

All of the tests included six transverse rupture bars: three were tested for transverse rupture strength, and three were used for the drilling tests.

Each of the three bars used for the drilling test had two holes machined in it. Only after all three bars had been tested was a new drill bit used i.e. one drill bit was used for each test series, or six holes.

Procedure and specifications for drilling test

| | |
|---|---|
| Equipment: | 1 Drill Stand<br>1 Power Drill<br>1 Drill Bit |

Drill Stand: The stand was a steel arbor press having an adjustable height. No fasteners were used to fasten the stand to the work bench, thereby allowing the whole apparatus to be moved with ease.

The drill was attached to a sliding ring and support column on the stand. The sliding ring weighed 8.43 lbs.

Power Drill: Model—Skil Model 97—Standard Duty Reversing ⅜' Drill—0-900 RPM

110 Volts 2.5 Amp Type 1 The drill weighed 3.5 lbs.

Drill Bit: 3/16 inch short shank drill bit—135 degree split point.

HS Screw Machine Drill Weight 6.04 g or 0.13 lbs. (ave. of 10 drills) Drills are purchased from Laurel Bolt and Supply Co., Inc Catalog No. 701TC.

Procedure: A test bar was secured in a vice and positioned beneath the drill stand. The drill bit was placed in the chuck which was then tightened. The drill was turned on and set to run at maximum speed without operator control.

The drill point was then positioned over an appropriate location on the bar and was lowered as close as possible to bar without touching. The drill and stand assembly was then allowed to fall under gravity until the drill had machined a continuous hole through the test bar. The total falling weight was 11.93 lbs. An operator timed the drilling time in seconds with a stop watch.

A drilling speed in seconds per inch was then calculated from the height of the bar. The six values for each test were then averaged.

The results are set out in the following tables:

EXAMPLE 1

| | % Sn/Bi | % Cu/Bi | % C | % Sn | % Fe | TRS (psi) | Drilling Speed in/min |
|---|---|---|---|---|---|---|---|
| Control | 0.0 | 0.0 | 0.0 | 0.0 | 0.0 | 73200 | 0.34 |
| 1 | 0.0 | 0.0 | 0.1 | 0.0 | 0.0 | 69900 | 0.42 |
| 2 | 0.0 | 0.0 | 0.3 | 0.0 | 0.0 | 67900 | 0.73 |
| 3 | 0.0 | 0.0 | 0.5 | 0.0 | 0.0 | 59500 | 1.33 |
| 4 | 0.0 | 0.0 | 0.5 | 1.0 | 1.0 | 69800 | 1.05 |
| 5 | 0.0 | 0.0 | 0.5 | 1.0 | 0.0 | 63800 | 1.02 |
| 6 | 1.0 | 0.0 | 0.0 | 0.0 | 0.0 | 72800 | 0.36 |
| 7 | 1.0 | 0.0 | 0.5 | 0.0 | 0.0 | 67500 | 1.00 |
| 8 | 1.0 | 0.0 | 0.5 | 0.0 | 1.0 | 60200 | 1.72 |
| 9 | 0.0 | 1.0 | 0.0 | 0.0 | 0.0 | 60000 | 0.50 |
| 10 | 0.0 | 1.0 | 0.5 | 0.0 | 0.0 | 45800 | 1.80 |
| 11 | 0.0 | 1.0 | 0.5 | 1.0 | 1.0 | 58000 | 2.97 |

EXAMPLE 2

| | % C | % SN/BI | % SN | TRS (psi) | Drilling Speed in/min |
|---|---|---|---|---|---|
| Control | 0.0 | 0.0 | 0.0 | 52300 | 0.42 |
| 1 | 0.5 | 0.0 | 0.0 | 32400 | 5.48 |
| 2 | 0.5 | 1.0 | 0.0 | 45300 | 3.34 |
| 3 | 0.5 | 0.0 | 1.0 | 34360 | 1.83 |

EXAMPLE 3

| | % C | % SN/BI | % SN | TRS (psi) | Drilling Speed in/min |
|---|---|---|---|---|---|
| Control | 0.0 | 0.0 | 0.0 | 68600 | 0.37 |
| 1 | 0.5 | 0.0 | 0.0 | 54900 | 1.25 |
| 2 | 0.5 | 1.0 | 0.0 | 61700 | 0.57 |
| 3 | 0.5 | 0.0 | 1.0 | 59600 | 0.87 |

Reviewing Table 1 it will be apparent that the incorporation of proportions of graphite result in a substantial increase in the drilling speed for each sample. For example, the drilling speed was increased from 0.34 to 0.42 inches per minute for sample one with a slight decrease in transverse rupture strength. The incorporation of tin and iron and of graphite on the other hand, sample 4, showed a substantial increase in drilling time over 0.34 inches per minute and this was also accompanied by a slight decrease in transverse rupture strength.

It will be seen from the foregoing that increasing amounts of graphite result in a continued increase in drilling speed but by the addition of other alloy factors it is possible to maintain a good transverse rupture strength and at the same time maintaining reasonable machinability.

By incorporating copper bismuth and tin bismuth significant increases in drilling speeds recorded are to be noted, although it will also be noted that the transverse strength is reduced.

The man skilled in the art, therefore, will appreciate that by selecting the desired combination of tin bismuth and copper bismuth prealloy, together with a quantity of graphite to be added, the machinability as measured by drilling speed, together with the transverse strength can be controlled to within predefined limits over a fairly wide range.

EXAMPLE 4

CONTROL

Specific alloys were prepared from a base alloy of copper zinc which alloys were formed into $\frac{1}{4}$ inch bar. All test specimens were standard MPIF transverse rupture bars pressed to a reported green density of 7.6. The test specimens were all sintered at 1600° F. for a total time of 45 minutes under a dissociated ammonia atmosphere.

The bar was tested for its transverse strength and was found to have a transverse rupture strength of 73000 lbs per square inch. The drilling speed in inches per minute was 0.34.

SAMPLE A

In accordance with the present invention a bar was prepared of the same material to which 0.5% of carbon graphite had been added prior to compaction on sintering. In this case the resultant bar had a transverse strength of 59000 lbs The drilling speed, however, was 1.3 inches per minute.

SAMPLE B

Sample A was repeated, but the 0.5% of carbon graphite was substituted by 1% by weigth of a copper bismuth prealloy containing 50% copper and 50% bismuth. The resultant bar had a transverse rupture strength of 60000 lbs per square inch. The drilling speed was 0.5 inches per minute.

SAMPLE C

Sample A was repeated but the carbon graphite was replaced by 1% by weigth of tin bismuth. The transverse strength on this occasion was 72800 lbs per squar inch. The drill speed however, had fallen to 0.38 inches per minute.

SAMPLE D

In this example 1% by weight of copper bismuth prealloy was added to the carbon graphite alloy of Sample A and the experiment repeated. In this case the transverse strength obtained was 46000 lbs per square inch. The drilling speed in this case was 1.80 inches per minute.

SAMPLE E

In this example, Sample D was repeated but the copper bismuth prealloy was substited by 1% by weight of tin bismuth prealloy. The resultant bar had a transverse strength of 67500 lbs per square inch. The drilling speed in this case was 1.0 inches per minute.

It will be appreciated from the foregoing, therefore, that by tailoring the proportions of copper bismuth or tin bismuth prealloy with the amount of graphite the transverse rupture strength and the drill speed can be controlled within fairly fine limits. The man skilled in the art will note, however, that significant increases in machinability tend to be obtained with expense of transverse strength of material.

We claim:

1. A brass powder composition consisting essentially of:

(a) 10–30% wt. zinc;
(b) 70–90% wt. copper:
(c) 0.1–1.5% wt. graphite; and
(d) 0.1–2.4% wt. bismuth pre-alloys selected from the group consisting of bismuth-tin and bismuth-copper, wherein bismuth is present in an amount of up to 2% wt. on an elemental basis, provided that said brass powder composition contains less than 2% wt. lead.

2. The brass powder composition of claim 1 further comprising a lubricant.

3. The brass powder metallurgy composition of claim 1 wherein said bismuth pre-alloy is bismuth-tin.

4. The brass powder metallurgy composition of claim 2 wherein said bismuth pre-alloy ms bismuth-tin.

5. The brass powder metallurgy composition of claim 1 wherein said bismuth pre-alloy is bismuth-copper.

6. The brass powder metallurgy composition of claim 2 wherein said bismuth pre-alloy is bismuth-copper.

7. A brass powder metallurgy composition, having improved machinability characteristics, for use in manufacturing a brass part by powder metallurgy techniques, said composition consisting essentially of:

(a) from 10–30% wt. zinc;
(b) from 70–90% wt. copper;
(c) from 0.1–1.5% wt. graphite; and
(d) up to about 2% wt. lead.

8. The brass powder metallurgy composition of claim 7 wherein said composition is substantially lead-free.

9. The brass powder metallurgy composition of claim 7 wherein said composition comprises 0.1–0.5% wt. graphite.

10. A brass powder metallurgy composition, having improved machinability characteristics, for use in manufacturing a brass part by powder metallurgy techniques, said composition consisting essentially of:

(a) from 10–30% wt. zinc;
(b) from 70–90% wt. copper;
(c) from 0.1–1.5% wt. graphite;
(d) up to about 2% wt. lead; and
(e) a minor amount of a powder metallurgy lubricant.

11. The brass powder metallurgy composition of claim 10 wherein said composition is substantially lead-free.

12. The brass powder metallurgy composition of claim 10 wherein said composition comprises 0.1–0.5% wt. graphite.

13. The brass powder metallurgy composition of claim 10 wherein said powder metallurgy lubricant is selected from the group consisting of waxes, metallic stearates, non-metallic stearates, molybdenum disulfide, and tungsten disulfide.

14. A brass powder composition consisting essentially of:

(a) 10–30% wt. zinc;
(b) 70–90% wt. copper:
(c) 0.1–1.5% wt. graphite; and
(d) bismuth, present in an amount of up to 2% wt. on an elemental basis;

provided that said brass powder composition contains less than 2% wt. lead.

15. The brass powder metallurgy composition of claim 14 wherein said composition is substantially lead-free.

16. The brass powder metallurgy composition of claim 14 wherein said composition comprises 0.1–0.5% wt. graphite.

17. The brass powder metallurgy composition of claim 14 further comprising a lubricant.

18. A brass part manufactured from a brass powder metallurgy composition by powder metallurgy techniques, said composition consisting essentially of:

(a) 10–30% wt. zinc;

(b) 70–90% wt. copper:

(c) 0.1–1.5% wt. graphite; and (d) bismuth, present in an amount of up to 2% wt. on an elemental basis, in either its elemental form or as a prealloy of bismuth-tin or bismuth-copper;

provided that said brass powder composition contains less than 2% wt. lead.

19. The brass part of claim 18 wherein said composition further comprises a lubricant.

* * * * *